United States Patent [19]

Ponghis et al.

[11] 4,421,553

[45] Dec. 20, 1983

[54] PROCESS FOR OPERATING A BLAST FURNACE

[75] Inventors: Nikolas Ponghis, Neuville-en-Condroz; Arthur Poos, Embourg; Roland Vidal, Grivegnes, all of Belgium

[73] Assignee: Centre de Recherches Metallurgiques, Liege, Belgium

[21] Appl. No.: 247,018

[22] Filed: Mar. 24, 1981

[30] Foreign Application Priority Data

May 6, 1980 [BE] Belgium ..... 6/47178

[51] Int. Cl.[3] ..... C21B 4/00

[52] U.S. Cl. ..... 75/41; 75/60

[58] Field of Search ..... 75/41, 60

[56] References Cited

U.S. PATENT DOCUMENTS

| | | | |
|---|---|---|---|
| 3,719,811 | 3/1973 | Munson | 75/41 |
| 3,853,539 | 12/1974 | Yoshiki | 75/41 |
| 4,227,921 | 10/1980 | Matoba | 75/41 |
| 4,273,577 | 6/1981 | Fujita | 75/41 |

FOREIGN PATENT DOCUMENTS

| | | | |
|---|---|---|---|
| 1007050 | 3/1977 | Canada . | |
| 51-73412 | 12/1976 | Japan | 75/41 |
| 54-107706 | 2/1979 | Japan | 75/41 |
| 54-69512 | 6/1979 | Japan | 75/41 |
| 1332531 | 10/1973 | United Kingdom . | |

OTHER PUBLICATIONS

AIME–Operation of a Blast Furnace with Super Hot Reducing Gas, Ponghis et al., pp. 224–229, Mar. 1979.

*Primary Examiner*—Peter D. Rosenberg
*Attorney, Agent, or Firm*—Holman & Stern

[57] ABSTRACT

In a method of controlling a blast furnace wherein iron ore is reduced to form pig iron and there being at least one reactor used for heating a reducing gas which reducing gas is introduced to at least one tuyere, the improvement being the steps of adjusting the composition and the temperture of the reducing gas in order to control at least one of the following: coke rate, productivity of the blast furnace, temperature and/or silicon content of the pig iron, and temperature of the top gas. Preferably, the reactor is a plasma torch and the temperature of the reducing gas is in the range of 1500°–2800° C. The coke rate is predetermined at a value of 50–350 kg/mt of pig iron and preferably at 80–200 kg/mt of pig iron produced.

11 Claims, No Drawings

PROCESS FOR OPERATING A BLAST FURNACE

BACKGROUND OF THE INVENTION

The present invention relates to a process for operating a blast furnace wherein iron ore is reduced to form pig iron, where reducing gas superheated to a temperature of up to 2000° C. and higher is injected into the lower part of this furnace, for example at the level of the main blast furnace tuyeres.

Present-day energy saving considerations have pushed the industrial sector, in particular iron and steelmakers, to reduce consumption of primary energy to a strict minimum and to replace certain types of energy by others that are cheaper or more readily available. As long as hydrocarbons could be purchased in large amounts and at a very low price tuyere injection of oil, natural gas, etc., made possible to replace as much as 20% of the metallurgical coke in the blast furnace. Under the present conditions, these types of injectants have to be replaced by other fuels such as, for example, coal.

Another possibility which is a well known process is the injection of hot reducing gas at the level of the main tuyeres of the furnace in order to reduce coke consumption. This reducing gas contains primarily CO, $H_2$ and possibly $N_2$, as well as small amounts of $CO_2$ and $H_2O$. It can be produced outside the furnace, in an independent unit or preferably directly in the injection circuit of the furnace. Such reducing gas can be injected into the furnace, to replace, totally or in part, the hot blast normally used. However, it must be well understood that within the scope of the present invention, those tuyeres through which hot reducing gas is injected are not used for blowing hot blast or any similar oxidizing agent. In the advantageous embodiment wherein hot reducing gas is injected through all tuyeres, this hot reducing gas replaces totally the blast normally used in conventional operation. In another embodiment hot reducing gas may be injected through some tuyeres only and hot oxidizing gas (air, oxygenated air, and so on) is injected through the remaining tuyeres.

Different methods and apparatuses are proposed, by the present applicant and others, for producing the reducing gas from different fuel (solid, liquid or gas) and oxidizing agents, including the use of recirculation gas as described in Canadian Pat. No. 1,007,050.

The high temperature to which this gas is brought, about 2000° C., can be obtained by different ways, preferably by means of electric devices such as plasma furnaces, arc heaters or similar equipment which have the double advantage of facilitating the necessary chemical reactions to produce such gas and furnishing the heat required for furnace operation. Such a process has been claimed by the applicant in U.K. Pat. Nos. 1,335,247; 1,332,531; 1,354,642; 1,459,659; and 1,488,976. Intensive research has been carried out to confirm the possibility of applying such a process on blast furnace equipment with a highly efficient operation for making hot metal.

This research was based on previous observation that heat and mass transfer in the blast furnace process is in no way modified if, instead of creating metallurgical reactions by the traditional method where gas is produced within the furnace by the combustion of coke with the hot blast, a gas having substantially the same composition and temperature is injected, such gas having been produced either in the injection circuit or outside the furnace and injected through the same tuyeres.

During the research, it was noted that other types of hot reducing gas can be injected. In this case, the blast furnace is operated in a significantly different manner from that of traditional blast furnace operation.

A paper presented by the inventors in Detroit, at the Iron-making Conference of Iron and Steel Society of the American Institute of Mining Metallurgical and Petroleum Engineers, March 1979, and published in the Proceedings, contains indications in this field. One of the main differences between the conventional blast furnace operation and the injection of superhot reducing gas process, as discussed in said paper, is the very low coke rate achieved. The lowest coke rate obtained during these tests described in said paper was 179 kg of dry coke/mtHM (metric ton of hot metal). This coke rate is substantially less than the value of 717 kg of dry coke/mtHM obtained in the experimental blast furnace when operated in a conventional manner (see Table I).

TABLE I

| Conventional versus Invention | | Experimental Furnace: Conventional Blast Furnace Operation | Experimental Furnace: Injection of Super hot reducing Gas Operation |
|---|---|---|---|
| Blast | Quantity ($Nm^3$/mtHM) | 2070 | 0 |
| | Temperature (°C.) | 748 | 0 |
| Reducing Gas | $H_2O + CO_2$ (%) | 0 | 6.9 |
| | Quantity ($Nm^3$/mtHM) | 0 | 2800 |
| | Temperature (°C.) | — | 2070 |
| Coke Rate | Kg/mtHM | 717 | 179 |
| Pig Iron | Productivity (mtHM/d) | 1.29 | 1.35 |
| | S. (%) | 0.64 | 0.31 |
| | Temperature (°C.) | 1410 | 1360 |
| Top Gas | Temperature (°C.) | 145 | * |

The temperature of the top gas is not known because it was so high that cooling water had to be added to the furnace top to prevent damage to the furnace.

During the research, it also appeared that the amount of hot reducing gas consumed to achieve these results was far in excess of what is theoretically required. This leads to an excessive energy consumption and is detrimental to the economics of the process. Furthermore, it was not then possible to adjust the furnace productivity to the selected set point.

Having thus proven that the application of this new technique to a conventional blast furnace is possible, new trials were conducted to find the best operating conditions which led to the present invention.

However, on the basis of the test results obtained from the new trials, it becomes possible to develop a method of control which simultaneously meets all the targets aimed at (i.e., coke rate, iron quality, furnace productivity and minimum energy consumption) and which also shows supplementary advantages compared to the conventional furnace operation.

BRIEF SUMMARY OF THE INVENTION

The object of the present invention is to reveal the conditions necessary for achieving a stable, economic, and smooth operation of a blast furnace into which superheated reducing gas is injected; the improvements of the process being the steps of adjusting the composition, temperature and/or flow of the reducing gas to control the coke rate, productivity of the furnace, temperature and silicon content of the pig iron and temperature of the top gas; the control of the last items is an interesting conservation measure because the sensible heat of this top gas is generally lost.

The present invention is essentially a method of controlling a blast furnace, wherein iron ore is reduced to form pig iron and at least one reactor is used for heating or producing and heating a reducing gas injected into the lower part of the furnace; the reducing gas contains primarily CO and $H_2$, and possibly $N_2$, and secondarily $CO_2$ and $H_2O$, and the temperature of the reducing gas is preferably in the range of 1500° to 2800° C. at the nose of the injection tuyere.

According to the invention, the blast furnace operation is controlled in the following manner:

(a) to control the coke rate, the content of $CO_2$ and/or $H_2O$ and possibly $N_2$ and the temperature of the reducing gas are varied; for increasing the coke rate, the content of $CO_2$ and/or $H_2O$ and/or $N_2$ and the temperature of the reducing gas are increased, and for decreasing the coke rate, the content of $CO_2$ and/or $H_2O$ and/or $N_2$ and the temperature of the reducing gas are decreased;

(b) to control the productivity of the furnace, the content of $CO_2$ and/or $H_2O$ and possibly $N_2$ and the temperature of the reducing gas are varied; for increasing the productivity of the furnace, the content of $CO_2$ and/or $H_2O$ and/or $N_2$ of the reducing gas is decreased and the temperature of the reducing gas is increased and for decreasing the productivity of the furnace the content of $CO_2$ and/or $H_2O$ and/or $H_2$ of the reducing gas is increased and the temperature of the reducing gas is decreased;

(c) to control the temperature and/or Si content of the pig iron, the temperature and the content of $CO_2$ and/or $H_2O$ in the reducing gas are varied; for increasing the temperature and/or Si content of the pig iron, the tempeature of the reducing gas is increased and the content of $CO_2$ and/or $H_2O$ of the reducing gas is decreased, and for decreasing the temperature and/or Si content of the pig iron, the temperature of the reducing gas is decreased and the content of $CO_2$ and/or $H_2O$ of the reducing gas is increased;

(d) to control the temperature of the top gas, the temperature of the reducing gas and the content of $CO_2$ and/or $H_2O$ and possibly $N_2$ of the reducing gas are varied; for increasing the temperature of the top gas, the temperature of the reducing gas is decreased and the content of $CO_2$ and/or $H_2O$ and/or $N_2$ of the reducing gas is increased, and for decreasing the temperature of the top gas, the temperature of the reducing gas is increased and the content of $CO_2$ and/or $H_2O$ and/or $N_2$ of the reducing gas is decreased.

The reactor used for injecting the reducing gas contains equipment, preferably an electric heater, i.e. a plasma heater, but any kind of equipment may be used, to heat or to produce and heat the reducing gas.

In keeping with the invention, the temperature of the reducing gas is regulated preferably by adjusting the electrical power needed, for example to form the plasma used in the heating operation. This embodiment has the advantage of not significantly affecting the composition of the reducing gas produced.

When the reducing gas is produced by introducing feedstock fuel (gaseous, liquid or solid carbonaceous fuels) and oxidizing gas, (air, recirculation gas, or others) into the reactor, changes to the composition of the reducing gas, especially the content of $CO_2$ and $H_2O$ in the reducing gas, are regulated by adjusting the ratio of feedstock fuel to oxidizing gas, that is to say, the ratio of the amount of feedstock fuel to oxidizing gas feeding the plasma furnace.

The reducing gas required in the process may be produced in a number of ways; i.e.:

(A) have gaseous, liquid or solid fuels react with air or any gas containing $O_2$ which is uncombined (oxygen-enriched air, etc.) to form maximum CO and $H_2$, in keeing with the reaction:

$$\text{Fuel} + O_2 \rightarrow x.CO + y.H_2;$$

(B) have gaseous, liquid or solid fuels react with $CO_2$ and/or steam or industrial gas containing $CO_2$ and/or steam and regulate the proportions of oxygen and fuels in such a manner that, following reaction, the gas produced contains a maximum of CO, $H_2$, $N_2$ and a minimum of $CO_2$ and $H_2O$, in keeping with the reaction:

$$\text{Fuel} + CO_2 \text{ and/or } H_2O \rightarrow w.CO + z.H_2;$$

(C) introduce the gaseous liquid or solid fuels together with an oxidizing agent, all of which may be preheated, into the production circuit upstream or downstream of the reactor-heating device; (in the case of a liquid fuel, the air of combustion, oxidizing agent, alone is superheated by the reactor);

(D) use effluents from metallurgical processes, such as top gas, after conditioning (filtering, total or partial removal of water and/or $CO_2$), which are caused to react with solid hydrocarbenaceous matter (coal, lignite) or a liquid hydrocarbonaceous matter (fuel-oil), or gas containing hydrocarbons, such as coke oven gas, natural gas, etc.; and (E) have fuels which are mixtures, such as slurry, suspension, emulsion, a mist or a foam, react with an oxidizing agent.

According to another embodiment of the invention, the coke rate of step (a) hereinabove can be controlled to any required value between 50 kg/mt and 350 kg/mt, and preferably between 80 kg/mt and 200 kg/mt of pig iron produced.

According to the control of step (a), the predetermined coke rate is obtained by modifying the composition and temperature of the reducing gas.

If a high coke rate is desired, reducing gas can be advantageously injected, in keeping with the invention, through some of the tuyeres, and hot oxidizing gas (i.e. air) through the other tuyeres, the hot oxidizing gas being heated to normal operating temperatures or superheated, using preferably electric technology such as a plasma torch, arc heater, and so on.

In a particularly advantageous embodiment of the invention, the temperature of the gas injected and the reducing potential of this gas are controlled independently to obtain a desired coke rate, lower than that obtainable by the best conventional methods, and at the same time to produce a fixed quantity of pig iron with desired silicon content, while ensuring the normal descent of the burden. The process comprises a first phase consisting of setting the values for the coke rate, the Si content and the production of the hot metal, and a second phase consisting in achieving a balanced operation of the furnace compatible with the set values of the coke rate and production and desired composition of liquid metal, by regulating the reducing gas composition, for example, by adjusting the ratio of feedstock fuel to oxidizing gas introduced into the reactor and by regulating the temperature of the reducing gas injected into the furnace, for example, by appropriately adjusting the electrical power supplied to the reactor heating the reducing gas injected into the furnace.

The present method thus offers a significant novelty, vis-a-vis prior art processes for operating a furnace: the coke rate may be varied at will according to the availability of raw materials, the economy of the operation, etc.; it must be remembered that in the process of injection of superheated reducing gas, the coke rate is lower than any coke rate previously obtainable in prior art processes; the silicon content of the hot metal may be more easily and more rapidly adjusted; and the working of the shaft furnace chosen and adjusted at will. This operation and control is achieved by adjusting the composition and temperature of the reducing gas injected into the shaft furnace. The advantages of this process are clear. The blast furnace operator may preselect, simultaneously, the coke rate, the productivity rate, the top gas temperature, and the hot metal Si content to achieve the optimum operation with his available raw materials and furnace configuration. The present invention permits continuous automatic and precise control of the process to a degree and extent heretofore unobtainable.

DETAILED DESCRIPTION OF THE INVENTION

The results compiled in Tables II to VIII hereinafter illustrate some of the numerous and important advantages of the method according to the present invention and how they can be obtained. For example, Tables II to V show that using the process of the invention for controlling the blast furnace, it is possible to reach (increasing or decreasing) any desired coke rate or characteristics of the pig iron (% Si, temperature), or temperature of the top gas.

Table II shows that by applying the process of the present invention, it is possible to modify the results from a reference operation 1 to another operation 2 with a fixed coke rate. It illustrates that a decrease of the coke rate from 175 to 105 kg/mtHM is obtained by decreasing the reducing gas temperature from 2050° to 2020° C. and the amount of $CO_2$ and $H_2O$ from 6.1 to 3.4% by vol. of the reducing gas. It must be pointed out that the quality of the pig iron and the top gas temperature are estimated constant from an industrial viewpoint.

TABLE II

| Coke Rate Adjustment | | Operation 1 | Operation 2 |
|---|---|---|---|
| Blast | Quantity (Nm3/mtHM) | 0 | 0 |
| Reducing | $H_2O + CO_2$ (%) | 6.1 | 3.4 |
| Gas | $N_2 + Ar$ (%) | 50.7 | 42.2 |
| | Quantity (Nm3/mtHM) | 1950 | 1900 |
| | Temperature °C. | 2050 | 2020 |
| Coke | Coke Rate (kg/mtHM) | 175 | 105 |
| Pig Iron | Si (%) | 0.64 | 0.78 |
| | Temperature (°C.) | 1410 | 1435 |
| Top Gas | Temperature (°C.) | 177 | 174 |

Table III shows that by applying the process of the present invention, it is possible to modify the temperature and Si content of the pig iron from a reference operation 3 to another operation 4. A decrease of the temperature from 1410° to 1360° C. and of the Si content from 0.60 to 0.30% of the pig iron is obtained by decreasing the temperature of the reducing gas from 2400° to 2350° C. and by increasing the amount of $CO_2$ and $H_2O$ from 3.53 to 4.0% of the reducing gas. The production value, the coke rate and the top gas temperature are estimated constant from an industrial viewpoint.

TABLE III

| Pig Iron Characteristic Adjustment | | Operation 3 | Operation 4 |
|---|---|---|---|
| Reducing | $H_2O + CO_2$ (%) | 3.53 | 4.0 |
| Gas | $N_2$ (%) | 40 | 40 |
| | Quantity ($Nm^3$/mtHM) | 1036 | 1020 |
| | Temperature | 2400 | 2350 |
| Coke | Coke Rate (kg/mtHM) | 169 | 169 |
| Pig Iron | Productivity (mtHM/h) | 191 | 193 |
| | Si (%) | 0.60 | 0.30 |
| | Temperature (°C.) | 1410 | 1360 |
| Top Gas | Temperature (°C.) | 109 | 97 |

Table IV shows that by applying the process of the present invention, it is possible to modify the top gas temperature from a reference operation 5 to another operation 6. A decrease of the temperature of the top gas from 350° to 109° C. is obtained by increasing the temperature of the reducing gas from 2100° to 2400° C. and decreasing the amount of $CO_2$ and $H_2O$ from 4.53 to 3.53% of the reducing gas, whereas the coke rate is maintained at essentially a constant value.

TABLE IV

| Top Gas Temperature Adjustment | | Operation 5 | Operation 6 |
|---|---|---|---|
| Reducing | $H_2O + CO_2$ (%) | 4.53 | 3.53 |
| Gas | $N_2$ (%) | 40 | 40 |
| | Temperature | 2100 | 2400 |
| Coke | Coke Rate (kg/mtHM) | 168 | 169 |
| Pig Iron | Si (%) | 0.60 | 0.60 |
| | Temperature | 1410 | 1410 |
| Top Gas | Temperature (°C.) | 350 | 109 |

If for any reason the operation of the blast furnace with a high coke rate is desired, higher than that which can be fixed with an operation where only superheated reducing gas is injected (coke rate between 80 kg/mtHM and 200 kg/mtHM it can also be obtained by simultaneously injecting superheated reducing gas through some tuyeres and hot air blast through the other tuyeres. Table V shows that by applying the process of the present invention, it is possible to modify the results from a reference operation 7 to another operation 8 with a much higher coke rate. It illustrates that if a high coke rate is desired 315 kg/mtHM without increasing the amount of $CO_2$ and $H_2O$, the injection of 1036 $Nm^3$/mtHM of superheated reducing gas at 2400° C. can be replaced by a simultaneous injection of 518 $Nm^3$/mtHM of superheated reducing gas at 2400° C., and of 535 $Nm^3$/mtHM of hot air blast.

TABLE V

| Coke Rate Adjustment with Simultaneous Injection | | Operation 7 | Operation 8 |
|---|---|---|---|
| Blast | Quantity ($Nm^3$/mtHM) | 0 | 535 |
| Reducing | $H_2O + CO_2$ (%) | 3.53 | 3.33 |
| Gas | $N_2$ (%) | 40 | 40 |
| | Quantity ($Nm^3$/mtHM) | 1036 | 518 |
| | Temperature (°C.) | 2400 | 2400 |
| Coke | Coke Rate (kg/mtHM) | 169 | 315 |
| Pig Iron | Productivity (mtHM/h) | 191 | 170 |
| | Si (%) | 0.6 | 0.6 |
| | Temperature (°C.) | 1410 | 1492 |
| Top Gas | Temperature (°C.) | 109 | 120 |

Changes to the ratio of oxidizing agent to feedstock fuel alters the amount of $CO_2$ and $H_2O$ in the reducing gas produced by the reactor. In Table VI example values are given wherein natural gas is the fuel and air is the oxidizing agent.

TABLE VI

| Air/Gas | Reducing Potential Ajustment $CO_2$ | $H_2O$ |
|---|---|---|
| 3.05 | 0.6 | 5.6 |
| 2.56 | 0.4 | 3.4 |

The effect of electric power input on the temperature of reducing gas produced in an electric reactor such as a plasma torch, are illustrated in Table VII.

TABLE VII

| Reducing Gas Temperature Adjustment | | |
|---|---|---|
| Gas Flow Rate $Nm^3/h$. | Electric Power Kwh | Temperature of Reducing Gas (°C.) |
| 110 | 85 | 1960 |
| 110 | 87.5 | 2000 |

What is claimed is:

1. In a method of continuously controlling a blast furnace wherein iron ore is reduced in the furnace to form pig iron having a temperature of 1300°-1600° C. and a Si % up to 2% and at least one reactor is used for heating a reducing gas, which reducing gas is introduced through at least one tuyere, the improvement comprising the steps of adjusting the composition and the temperature of the reducing gas in order to simultaneously control the following parameters: the coke rate; and temperature and Si content of the pig iron; wherein the temperature range of the reducing gas is between 1500°-2800° C. and the composition of the reducing gas is primarily CO, $H_2$, and possibly $N_2$, and small amounts of $CO_2$ and $H_2O$, the amount of $H_2O+CO_2$ being up to 193 $Nm^3$/mtHM;

(a) to control the coke rate within a value of between 50 kg/mt HM and 350 kg/mt HM of pig iron produced, the amount of at least one of the following components of the reducing gas selected from the group consisting of $CO_2$ or $H_2O$, and the temperature of the reducing gas is adjusted; for increasing the coke rate, the amount of said components and the temperature of the reducing gas are increased, and for decreasing the coke rate, the amount of said components and the temperature of the reducing gas are decreased; and (b) to control the temperature and Si content of the pig iron, the amount of said components and the temperature of the reducing gas are adjusted; for increasing the temperature and Si content of the pig iron, the temperature of the reducing gas is increased and the amount of said components of the reducing gas is decreased, and for decreasing the temperature and Si content of the pig iron, the temperature of the reducing gas is decreased and the amount of said components of the reducing gas is increased.

2. The method as claimed in claim 1, wherein said reactor contains an electric heater.

3. The method as claimed in claim 1 wherein said coke rate is between 80 kg/mtHM and 200 kg/mtHM of pig iron produced.

4. The method as claimed in claim 1 or 2, wherein the reducing gas is produced by the steps of introducing feedstock fuel and oxidizing gas into said reactor, and regulating the composition of the reducing gas, especially the amount of said components, by adjusting the ratio of feedstock fuel to oxidizing gas.

5. The method as claimed in claim 4, wherein said oxidizing gas is recirculated top gas from the blast furnace.

6. The method as claimed in claim 1, wherein said reactor contains an electric heater and the temperature of the reducing gas is varied by changing the electric power input.

7. The method as claimed in claim 1 or 2, comprising a further step of introducing hot oxidizing gas into the blast furnace, this hot oxidizing gas being injected through at least one tuyere distinct from the tuyere through which said reducing gas is injected.

8. The method as claimed in claim 7, wherein the hot oxidizing gas is air or oxygenated air.

9. The method as claimed in claim 1 wherein a further parameter, namely, productivity of the furnace, is controlled as follows: for increasing the productivity of the furnace, the amount of said components is decreased and the temperature of the reducing gas is increased; and for decreasing the productivity of the furnace, the amount of said components is increased and the temperature of the reducing gas is decreased.

10. The method as claimed in claim 1 wherein a further parameter, namely, temperature of the top gas, is controlled as follows: for increasing the temperature of the top gas, the temperature of the reducing gas is decreased and the amount of said components is increased; and for decreasing the temperature of the top gas, the temperature of the reducing gas is increased and the amount of said components of the reducing gas is decreased.

11. The method as claimed in claim 1, 9 or 10 wherein said reducing gas also contains some Ar, the amount of $N_2+Ar$ being an effective amount up to 988 $Nm^3$/mtHM; and in step (a) $N_2$ and Ar are inroduced as further components of said reducing gas.

* * * * *

UNITED STATES PATENT AND TRADEMARK OFFICE

CERTIFICATE OF CORRECTION

PATENT NO. : 4,421,553

DATED : December 20, 1983

INVENTOR(S) : Nikolas Ponghis; Arthur Poos; and Roland Vidal

It is certified that error appears in the above—identified patent and that said Letters Patent is hereby corrected as shown below:

On the title page;
Change the priority information to read --[30] June 5, 1980 [BE] Belgium 6/47178--

Signed and Sealed this

*Tenth* Day of *September 1985*

[SEAL]

*Attest:*

DONALD J. QUIGG

*Attesting Officer* *Acting Commissioner of Patents and Trademarks - Designate*